US006269558B1

(12) United States Patent
Alexander

(10) Patent No.: US 6,269,558 B1
(45) Date of Patent: Aug. 7, 2001

(54) ADJUSTABLE SNOW PLOW SHOVEL

(76) Inventor: Dante A. Alexander, 345 Hollywood Ave., Fairfield, NJ (US) 07004

( * ) Notice: Subject to any disclaimer, the term of this patent is extended or adjusted under 35 U.S.C. 154(b) by 0 days.

(21) Appl. No.: 09/659,720

(22) Filed: Sep. 8, 2000

(51) Int. Cl.[7] ..... E01H 5/02
(52) U.S. Cl. ..... 37/273; 37/278; 294/54.5
(58) Field of Search ..... 294/51, 53.5, 54.5, 294/57; 37/241, 265, 269, 272, 273, 278, 284, 285

(56) References Cited

U.S. PATENT DOCUMENTS

| | | | | |
|---|---|---|---|---|
| 323,656 | * | 8/1885 | Franz | 37/278 X |
| 731,419 | * | 6/1903 | Wykoff | 37/273 |
| 956,896 | * | 5/1910 | Gross | 37/273 |
| 1,049,812 | | 1/1913 | Darling | 294/54.5 X |
| 1,276,672 | * | 8/1918 | Mason | 37/278 X |
| 1,307,410 | * | 6/1919 | Morris | 37/273 |
| 1,746,859 | * | 2/1930 | Hurd | 37/273 |
| 2,432,780 | * | 12/1947 | Mader | 37/278 X |
| 2,782,533 | * | 2/1957 | Eslinger | 37/278 |
| 5,472,252 | | 12/1995 | Barone | 294/58 |
| 5,511,328 | | 4/1996 | Fingerer et al. | 294/54.5 X |
| 5,791,072 | * | 8/1998 | Schbot | 294/57 X |

* cited by examiner

*Primary Examiner*—Johnny D. Cherry
(74) *Attorney, Agent, or Firm*—Goldstein Law Offices P.C

(57) ABSTRACT

An adjustable snow plow shovel including a T-shaped handle comprised of a horizontal gripping member and an elongated vertical shaft member. The horizontal gripping member has opposed ends and a midpoint. The elongated vertical shaft member has an upper end and a lower end. The upper end is secured to the midpoint of the horizontal gripping member. The lower end has a pair of support brackets extending outwardly therefrom in opposite directions. The support brackets each have an angularly disposed outer end having an aperture therethrough. A pair of plow blades are pivotally coupled with a plow blade support. The plow blade support is secured to the lower end of the elongated vertical shaft member of the T-shaped handle. Each of the plow blades has a plurality of linearly aligned apertures therethrough on a horizontal plane in a spaced relationship. The apertures are selectively alignable with the apertures of the outer ends of the support brackets of the T-shaped handle for receiving a bolt therethrough that couples with a wing nut. The choice of aligning the apertures adjusts the width of the plow blades according to the depth of the snow to be plowed.

5 Claims, 3 Drawing Sheets

ADJUSTABLE SNOW PLOW SHOVEL

BACKGROUND OF THE INVENTION

The present invention relates to an adjustable snow plow shovel and more particularly pertains to allowing easy removal of snow from sidewalks and driveways through the use of adjusting the angle of snow blades and pushing rather than lifting and throwing, so as to reduce back strain common to shoveling. The operator can lean into it and keep going.

The use of snow removal devices is known in the prior art. More specifically, snow removal devices heretofore devised and utilized for the purpose of removing snow are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,511,328 to Fingerer discloses an adjustable hand operated snow plow capable of positioning a pair of blades in a variety of angular configurations. U.S. Pat. No. 1,049,812 to Darling discloses a combination snow plow and shovel constructed of two blades attached to a diamond shaped frame. U.S. Pat. No. 5,472,252 to Barone discloses a snow shovel with an adjustable handle.

While these devices fulfill their respective, particular objective and requirements, the aforementioned patents do not describe an adjustable snow plow shovel for allowing easy removal of snow from sidewalks and driveways.

In this respect, the adjustable snow plow shovel according to the present invention substantially departs from the conventional concepts and designs of the prior art, and in doing so provides an apparatus primarily developed for the purpose of allowing easy removal of snow from sidewalks and driveways with less effort and back strain.

Therefore, it can be appreciated that there exists a continuing need for a new and improved adjustable snow plow shovel which can be used for allowing easy removal of snow from sidewalks and driveways. In this regard, the present invention substantially fulfills this need.

SUMMARY OF THE INVENTION

In the view of the foregoing disadvantages inherent in the known types of snow removal devices now present in the prior art, the present invention provides an improved adjustable snow plow shovel. As such, the general purpose of the present invention, which will be described subsequently in greater detail, is to provide a new and improved adjustable snow plow shovel which has all the advantages of the prior art and none of the disadvantages.

To attain this, the present invention essentially comprises a T-shaped handle comprised of a horizontal gripping member and an elongated vertical shaft member. The horizontal gripping member has opposed ends and a midpoint. The elongated vertical shaft member has an upper end and a lower end. The upper end is secured to the midpoint of the horizontal gripping member. The upper end has a pair of supports secured thereto and secured to the horizontal gripping member. The lower end has a pair of support brackets extending outwardly therefrom in opposite directions. The support brackets each have an angularly disposed outer end having an aperture therethrough. A pair of plow blades are pivotally coupled with a plow blade support which is secured to the lower end of the elongated vertical shaft member of the T-shaped handle. Each of the plow blades has an inner edge and an outer edge. The inner edge is coupled to the lower end of the elongated vertical shaft member by a piano hinge. Each of the plow blades has a plurality of linearly aligned apertures therethrough on a horizontal plane in a spaced relationship. The apertures are selectively alignable with the apertures of the outer ends of the support brackets of the T-shaped handle for receiving a bolt therethrough that couples with a wing nut.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved adjustable snow plow shovel which has all the advantages of the prior art snow removal devices and none of the disadvantages.

It is another object of the present invention to provide a new and improved adjustable snow plow shovel which may be easily and efficiently manufactured and marketed.

It is a further object of the present invention to provide a new and improved adjustable snow plow shovel which is of durable and reliable construction.

An even further object of the present invention is to provide a new and improved adjustable snow plow shovel which is susceptible of a low cost of manufacture with regard to both materials and labor, and which accordingly is then susceptible of low prices of sale to the consuming public, thereby making such an adjustable snow plow shovel economically available to the buying public.

Even still another object of the present invention is to provide a new and improved adjustable snow plow shovel for allowing easy removal of snow from sidewalks and driveways.

Lastly, it is an object of the present invention to provide a new and improved adjustable snow plow shovel including a T-shaped handle comprised of a horizontal gripping member and an elongated vertical shaft member. The horizontal gripping member has opposed ends and a midpoint. The elongated vertical shaft member has an upper end and a lower end. The upper end is secured to the midpoint of the horizontal gripping member. The lower end has a pair of support brackets extending outwardly therefrom in opposite directions. The support brackets each have an angularly disposed outer end having an aperture therethrough. A pair of plow blades are pivotally coupled with a plow blade support which is secured to the lower end of the elongated vertical shaft member of the T-shaped handle. Each of the plow blades has a plurality of linearly aligned apertures therethrough on a horizontal plane in a spaced relationship. The apertures are selectively alignable with the apertures of the outer ends of the support brackets of the T-shaped handle for receiving a bolt therethrough that couples with a wing nut.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
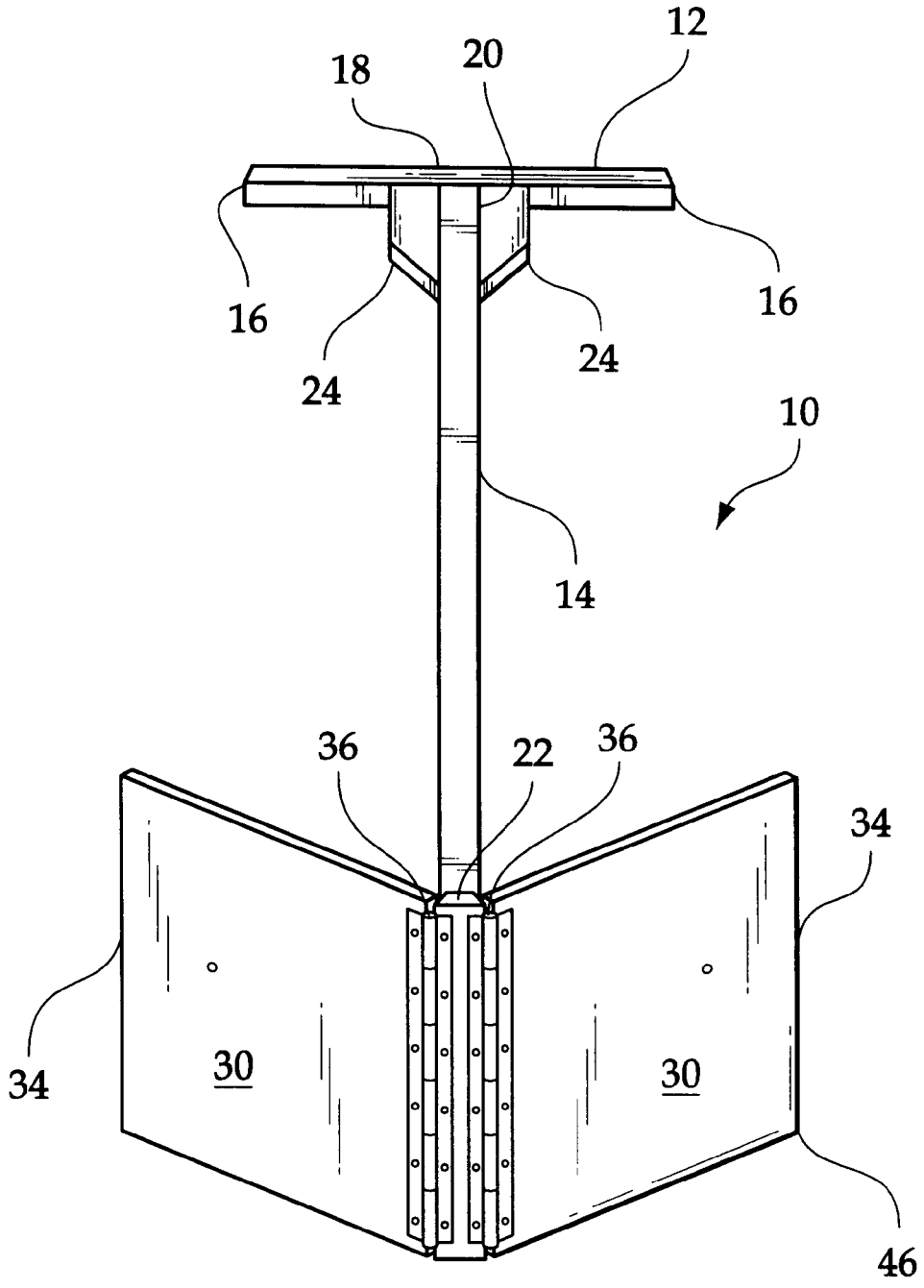
FIG. 1 is a front elevation view of the preferred embodiment of the adjustable snow plow shovel constructed in accordance with the principles of the present invention.
Figure 2:
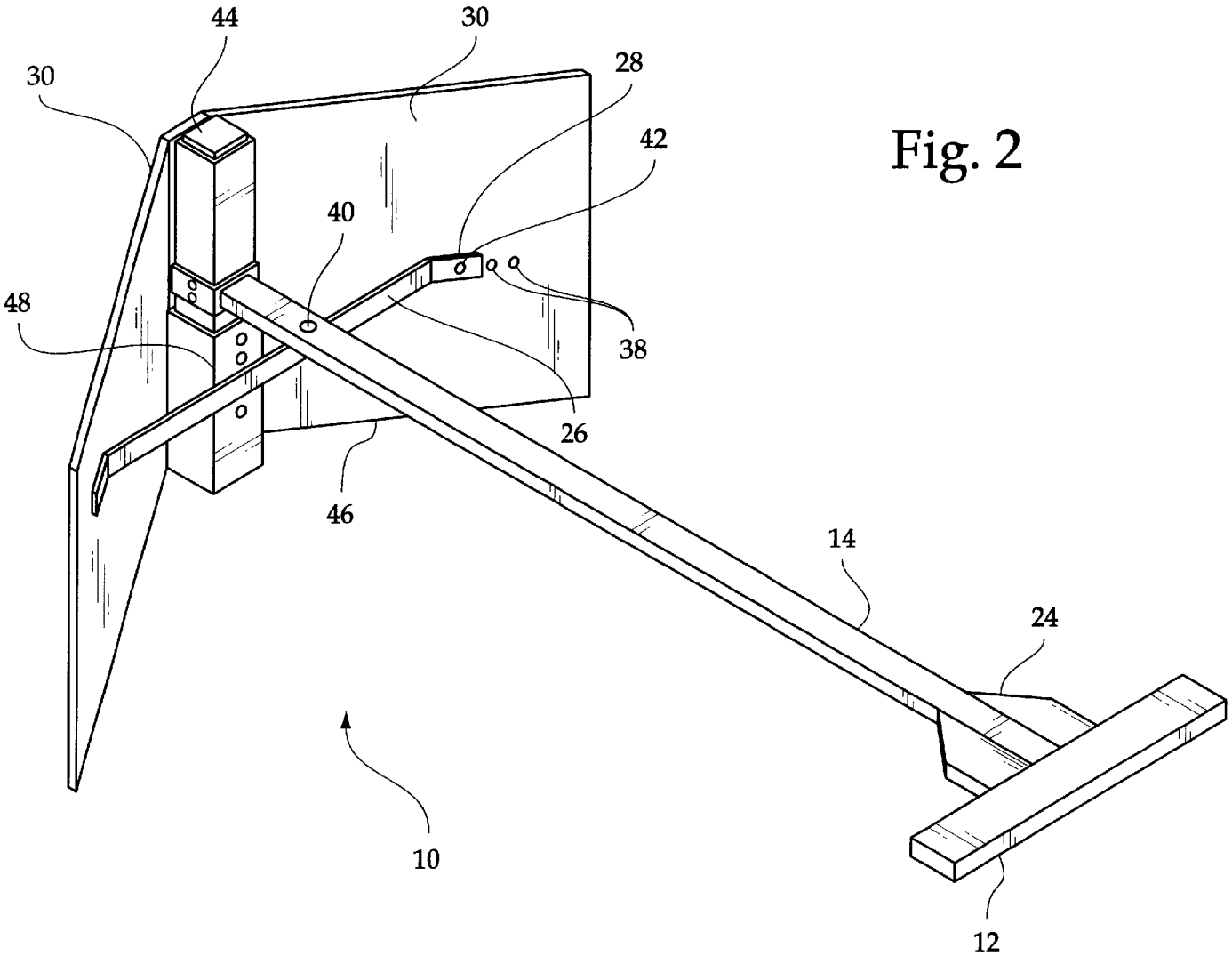
FIG. 2 is a rear view of the present invention.
Figure 3:
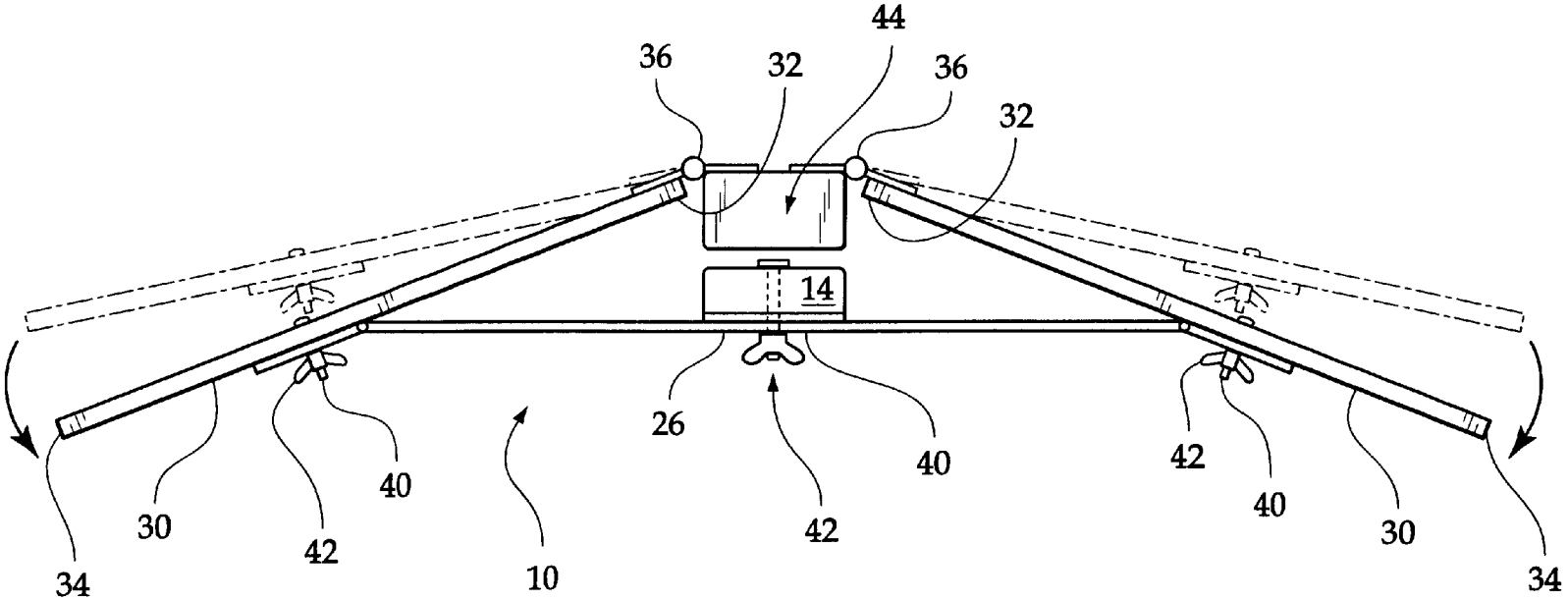
FIG. 3 is a bottom plan view of the present invention.

With reference now to the drawings, and in particular, to FIGS. 1 through 3 thereof, the preferred embodiment of the new and improved adjustable snow plow shovel embodying the principles and concepts of the present invention and generally designated by the reference number 10 will be described.

Specifically, it will be noted in the various Figures that the device relates to an adjustable snow plow shovel for allowing easy removal of snow from sidewalks and driveways. In its broadest context, the device consists of a T-shaped handle and a pair of plow blades. Such components are individually configured and correlated with respect to each other so as to attain the desired objective.

The T-shaped handle is comprised of a horizontal gripping member 12 and an elongated vertical shaft member 14. The horizontal gripping member 12 has opposed ends 16 and a midpoint 18. The elongated vertical shaft member 14 has an upper end 20 and a lower end 22. The upper end 20 is secured to the midpoint 18 of the horizontal gripping member 12. The upper end 20 has a pair of supports 24 secured thereto and secured to the horizontal gripping member 12. The pair of supports 24 provide stability to the device 10 during use. The lower end 22 has a pair of plow blades 30 attached with a piano hinge 36 to the inner edges of the plow blade support 44. The plow blade support 44 is attached to the lower end 22 of the vertical shaft member 14 with a metal angle iron 48 at a forty-five degree angle. A pair of support brackets 26 extend outwardly from the lower end of the vertical shaft member 14 in opposite directions. The support brackets 26 each have an angularly disposed outer end 28 having an aperture therethrough (not illustrated).

The pair of plow blades 30 are pivotally coupled with the plow blade support 44 at the lower end 22 of the elongated vertical shaft member 14 of the T-shaped handle. Each of the plow blades 30 has a plurality of linearly aligned apertures 38 therethrough on a horizontal plane in a spaced relationship. The apertures 38 are selectively alignable with the apertures of the outer ends 42 of the support brackets 26 of the T-shaped handle for receiving a bolt 40 therethrough that couples with a wing nut 42. Additionally, each plow blade could be provided with a metal U-strip bolted to the bottom thereof to serve as a wear bar. This can be easily replaced when necessary.

In operation, the pair of plow blades 30 are essentially disposed in a V-shape when in use so as to allow the user of the device 10 to push through snow so as to diverge the snow on opposite sides of the user as he pushes the device 10. The degree of the angle of the shovel blades 30 with respect to the T-shaped handle can be adjusted depending on the amount of snow being removed and the width of a space that is desired to be cleared by changing the choice of apertures to align within a few minutes and reattaching with the bolts and wing nuts.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An adjustable snow plow shovel for allowing easy removal of snow from sidewalks and driveways comprising, in combination:

a T-shaped handle comprised of a horizontal gripping member and an elongated vertical shaft member, the horizontal gripping member having opposed ends and a midpoint, the elongated vertical shaft member having an upper end and a lower end, the upper end secured to the midpoint of the horizontal gripping member with a pair of supports and secured to the horizontal gripping member, the lower end having a pair of support brackets extending outwardly therefrom in opposite directions, the support brackets each having an angularly disposed outer end having an aperture therethrough; and a pair of plow blades pivotally coupled with a plow blade support, the plow blade support secured to the lower end of the elongated vertical shaft member of the T-shaped handle, each of the plow blades having a plurality of linearly aligned apertures therethrough on a horizontal plane in a spaced relationship, the apertures being selectively alignable with the apertures of the outer ends of the support brackets of the T-shaped handle for receiving a bolt therethrough that couples with a wing nut.

2. An adjustable snow plow shovel for allowing easy removal of snow from sidewalks and driveways comprising, in combination:

a T-shaped handle comprised of a horizontal gripping member and an elongated vertical shaft member, the horizontal gripping member having opposed ends and a midpoint, the elongated vertical shaft member having an upper end and a lower end, the upper end secured to the midpoint of the horizontal gripping member, the lower end having a pair of support brackets extending outwardly therefrom in opposite directions, the support brackets each having an angularly disposed outer end having an aperture therethrough; and a pair of plow blades pivotally coupled with the lower end of the elongated vertical shaft member of the T-shaped handle, each of the plow blades having a plurality of linearly aligned apertures therethrough on a horizontal plane in a spaced relationship, the apertures being selectively alignable with the apertures of the outer ends of the support brackets of the T-shaped handle for receiving a bolt therethrough that couples with a wing nut.

3. The adjustable snow plow shovel as set forth in claim 2, wherein the upper end of the elongated vertical member of the T-shaped handle has a pair of supports secured thereto and secured to the horizontal gripping member.

4. The adjustable snow plow shovel as set forth in claim 2, wherein each of the plow blades has an inner edge and an outer edge, the inner edge being coupled to the lower end of the elongated vertical shaft member by a piano hinge.

5. The adjustable snow plow shovel as set forth in claim 1, wherein each plow blade has a metal U-strip secured to a lower edge thereof.

* * * * *